US007527656B2

(12) United States Patent
Griffin et al.

(10) Patent No.: US 7,527,656 B2
(45) Date of Patent: May 5, 2009

(54) PROCESS FOR THE THERMAL AND PHOTOCHEMICAL STABILIZATION OF DYED POLYAMIDE FIBER MATERIAL

(75) Inventors: Bruce Owen Griffin, Kernersville, NC (US); Jack Thurman Larkins, Jr., Kernersville, NC (US); George Dukes Crosby, Dalton, GA (US)

(73) Assignee: Huntsman International LLC, The Woodlands, TX (US)

( * ) Notice: Subject to any disclaimer, the term of this patent is extended or adjusted under 35 U.S.C. 154(b) by 108 days.

(21) Appl. No.: 11/475,700

(22) Filed: Jun. 27, 2006

(65) Prior Publication Data

US 2007/0011822 A1 Jan. 18, 2007

Related U.S. Application Data

(60) Provisional application No. 60/695,380, filed on Jun. 30, 2005.

(51) Int. Cl.
*C09B 67/00* (2006.01)

(52) U.S. Cl. ..... 8/566; 8/115.51; 8/115.59; 8/115.6; 8/445; 252/8.61; 252/8.84

(58) Field of Classification Search ..... 8/115.51, 8/115.6, 115.59, 445, 566; 252/8.61, 8.84
See application file for complete search history.

(56) References Cited

U.S. PATENT DOCUMENTS 5,871,669 A * 2/1999 Tittmann et al. ..... 252/402
6,723,256 B1 * 4/2004 Heller ..... 252/301.21

* cited by examiner

*Primary Examiner*—Douglas Mc Ginty
*Assistant Examiner*—Amina Khan

(57) ABSTRACT

A process for enhancing the thermal, oxidative and photochemical stability of dyed or printed polyamide fiber material, comprises treating the polyamide fiber material, before, during or after a dyeing or printing step, with an effective stabilizing amount of a stabilizer mixture which comprises at least one compound of the formula (1)

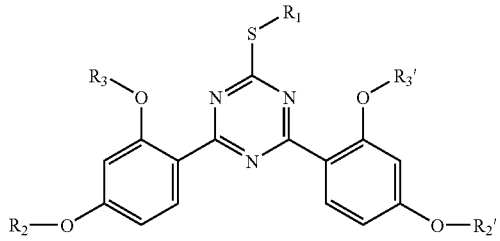

and at least one compound of the formula (2)

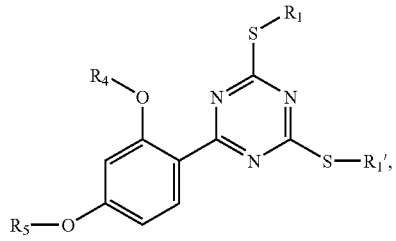

in which $R_1$ and $R_1'$ independently of one another are each linear or branched $C_1$-$C_{18}$alkyl, $C_3$-$C_8$cycloalkyl, $C_3$-$C_6$alkenyl, unsubstituted or substituted aryl or $C_7$-$C_{12}$aralkyl, and $R_2$, $R_2'$, $R_3$, $R_3'$, $R_4$ and $R_5$ are as described herein. The treated polyamide fiber materials have excellent thermal, oxidative and photochemical stability.

11 Claims, No Drawings

PROCESS FOR THE THERMAL AND PHOTOCHEMICAL STABILIZATION OF DYED POLYAMIDE FIBER MATERIAL

This application claims the benefit under 35 U.S.C. 119(e) of U.S. Provisional Application No. 60/695,380, filed Jun. 30, 2005.

The present invention is directed to a process for enhancing the thermal, oxidative and photochemical stability of dyed or printed polyamide fiber material with selected triazine UV absorbers. More particularly it is directed to a process for enhancing the thermal, oxidative and photochemical stability of dyed or printed polyamide carpet materials as well as other polyamide fabrics that must meet stringent hot lightfastness testing requirements, for example those of the automotive fabrics industry.

Over the last five to ten years the automotive fabrics industry has undergone significant changes in testing requirements, particularly lightfastness testing requirements. Prior to 2002 the SAE J1885 lightfastness test method was accepted by Chrysler, Ford, and GM with 225 kj being the most severe exposure for polyamide material. Therefore the automotive textile industry almost universally used organic copper complexed photostabilizers, optionally in the presence of benzotriazoles, to protect polyamide automotive textiles.

Several new test methods have been implemented in the last two years, particularly by General Motors. Examples of recently implemented test methods include the GM requirements for lightfastness as specified in the GM9538P outdoor method performed in the Arizona DPG (Desert Proving Grounds) and the GMW3414 accelerated test method that correlates with the GM9538P, as well as other hot lightfastness test methods such as Toyota's Method TSL2606G. GM has applied their tests to the evaluation of dyed nylon carpet as well as other textile fabrics. Also in non-automotive applications, extended exposures in traditional lightfastness test methods such as AATCC 16-2004 and MTCC 169-2003 have placed more demands on the performance of these fabrics.

Most of the changes in these test methods increase the severity of the testing in terms of the temperature and length of exposure, and they reduce the filtering of the light source, which is typically radiation from a xenon bulb of some type. In the new hot lightfastness test methods, the higher temperatures and adjusted filters much more strongly degrade the chromophores, especially in nylon textiles. All of these factors have dramatically increased the failure rate of the traditional UV absorber chemistries used in the coloration of polyamide textiles in automotive and non-automotive fabrics, resulting in fabrics that exhibit unacceptable levels of color fade and strength loss which prove very difficult to overcome. Indeed the pass rate for current UV absorber systems is still very low, estimated at 30%-50% for the more demanding requirements.

It is known to stabilize polyamide fibers with organic copper-complexed photostabilizers such as those described U.S. Pat. Nos. 4,655,783, 4,704,133, 4,775,386 and 4,990,164. In addition to benzotriazoles and hindered phenols such as those described U.S. Pat. Nos. 5,142,059, 5,181,935 and 5,356,443, it is known to enhance the thermal and/or photochemical stability of dyeings on polyamides with certain water soluble triazine derivatives such as those disclosed in DE 44 29 470 and U.S. Pat. Nos. 4,831,068, 5,160,346, 5,181,935, 5,197,991, 5,281,707, 5,457,198, 5,578,677, 5,696,262 and 5,700,295. However, even with these triazines, alone and in combination with organic copper-complexed photostabilizers and/or benzotriazoles and hindered phenols, the results have not been completely satisfactory. Thus there is still a need for improved stabilizers and stabilizer combinations for polyamide fiber materials.

Surprisingly, a process for enhancing the thermal, oxidative and photochemical stability of dyed or printed polyamide fiber material has now been found, which comprises treating the polyamide fiber material, before, during or after a dyeing or printing step in a substantially aqueous medium, with an effective stabilizing amount of a stabilizer mixture which comprises at least one compound of the formula (1)

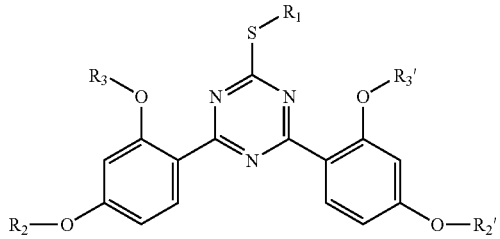

and at least one compound of the formula (2)

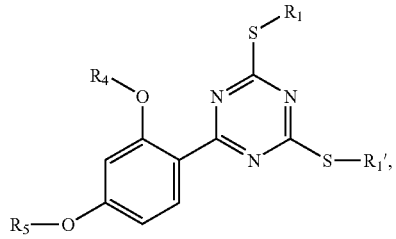

in which $R_1$ and $R_1'$ independently of one another are each linear or branched $C_1$-$C_{18}$alkyl, $C_3$-$C_8$cycloalkyl, $C_3$-$C_6$alkenyl, unsubstituted or substituted aryl or $C_7$-$C_{12}$aralkyl, $R_2$, $R_2'$, $R_3$, $R_3'$, $R_4$ and $R_5$ independently of one another are each hydrogen, unsubstituted or substituted, linear or branched $C_1$-$C_{12}$alkyl, or linear or branched $C_4$-$C_{28}$alkyl, which is interrupted by one or more N, S or O atoms and which may be substituted further or are a radical —CO—$R_6$ or —$SO_2$—$R_6$, and $R_6$ is $C_1$-$C_{12}$alkyl, unsubstituted or $C_1$-$C_4$alkyl-substituted phenyl or $C_7$-$C_{12}$aralkyl.

$R_1$ and $R_1'$ as $C_1$-$C_{18}$alkyl comprise straight-chain or branched alkyl radicals, for example, methyl, ethyl, n- or isopropyl, n-, iso-, sec- or tert-butyl, 2-ethylbutyl, n- or isopentyl, 1-methylpentyl, 1,3-dimethylbutyl, n-hexyl, 1-methylhexyl, n- or isoheptyl, 1,1,3,3-tetra-methylbutyl, 1-methylheptyl, 3-methylheptyl, n-octyl, 2-ethylhexyl, 1,1,3-trimethylhexyl, 1,1,3,3-tetramethylpentyl, nonyl, decyl, undecyl, dodecyl, 1,1,3,3,5,5-hexamethylhexyl, tridecyl, tetradecyl, pentadecyl, hexadecyl, heptadecyl or octadecyl. $R_1$ and $R_1'$ as alkyl, independently of one another, are each preferably $C_1$-$C_6$alkyl, particularly preferably $C_1$-$C_4$alkyl, and with particular preference are each methyl.

$R_1$ and $R_1'$ as a cycloalkyl radical comprise, for example, a saturated 3- to 8-membered carbocyclic ring, which is unsubstituted or substituted by one or more $C_1$-$C_4$alkyl groups, preferably methyl groups. Examples are cyclopentyl, cyclohexyl, methylcyclohexyl or cycloheptyl. As a cycloalkyl radical, $R_1$ and $R_1'$ are preferably and independently of one another each cyclohexyl which is unsubstituted or substituted by 1-3 methyl groups.

Examples of suitable alkenyl radicals $R_1$ or $R_1'$ are allyl, isopropenyl, 2-butenyl, 3-butenyl, isobutenyl, n-penta-2,4-dienyl or 3-methylbut-2-enyl. $R_1$ and $R_1'$ as an alkenyl radical are, independently of one another, each preferably allyl or isopropenyl, and with particular preference are each allyl.

$R_1$ and $R_1'$ as an aryl radical are, for example, a biphenyl, naphthyl, or in particular, a phenyl radical, each of which can be substituted further by, for example, $C_1$-$C_4$alkyl, $C_1$-$C_4$alkoxy or halogen. Preferred definitions of $R_1$ and $R_1'$ as aryl radical are, independently of one another, each unsubstituted or $C_1$-$C_4$alkyl-substituted phenyl, and with particular preference are in each case phenyl.

Examples of suitable aralkyl radicals $R_1$ and $R_1'$ are benzyl, α-methylbenzyl, phenylethyl, phenylpropyl, phenylbutyl, phenylpentyl or phenylhexyl. $R_1$ and $R_1'$ as an aralkyl radical, independently of one another, are each preferably benzyl or α-methylbenzyl, and with particular preference are each benzyl.

Where $R_2$, $R_2'$, $R_3$, $R_3'$, $R_4$ or $R_5$ are $C_1$-$C_{12}$alkyl, this can, for example, be one of the $C_1$-$C_{12}$alkyl radicals mentioned above for $R_1$ or a corresponding $C_1$-$C_{12}$alkyl radical which is substituted, for example, by halogen, cyano, hydroxyl, amino, $C_1$-$C_4$alkoxycarbonyl, carbamoyl, N-mono- or N,N-di-$C_1$-$C_4$alkylcarbamoyl, glycidyl or phenyl.

The radicals $R_1$ and $R_1'$ can be different or, preferably, identical.

A preferred embodiment of the present invention relates to treatment with stabilizer mixtures comprising at least one of each compound of the above formulae (1) and (2) in which $R_1$ and $R_1'$ independently of one another are each $C_1$-$C_6$alkyl, cyclohexyl which is unsubstituted or substituted by 1-3 methyl groups, or are allyl, isopropenyl, unsubstituted or $C_1$-$C_4$alkyl-, $C_1$-$C_4$alkoxy- or halo-substituted phenyl, benzyl or α-methylbenzyl.

A particularly preferred embodiment of the present invention relates to treatment with stabilizer mixtures comprising at least one of each compound of the above formulae (1) and (2) in which $R_1$ and $R_1'$ are identical and are each $C_1$-$C_4$alkyl, cyclohexyl, allyl, phenyl or benzyl.

An especially preferred embodiment of the present invention relates to treatment with stabilizer mixtures of compounds of the above formulae (1) and (2) in which $R_1$ and $R_1'$ are identical and are each $C_1$-$C_4$alkyl. It is most especially preferred that the treatment is carried out in the presence of a stabilizer mixture comprising at least one compound of the formula (1a)

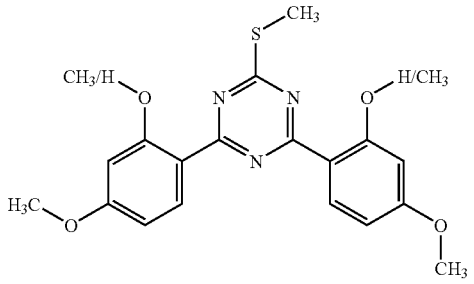

and at least one compound of the formula (2a)

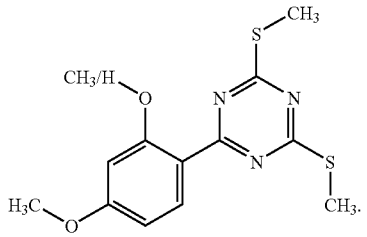

Especially preferred stabilizer mixtures are those comprising from 50 to 80% by weight of compounds of the above formulae (1a) and from 50 to 20% by weight of the compounds of the above formula (2a) based on the total weight of compounds of the formulae (1a) and (2a).

Stabilizer mixtures of compounds of the above formulae (1) and (2) are known per se and can be prepared by known methods. An aqueous dispersion of the mixture of stabilizer compounds of the above formulae (1a) and (2a) is commercially available from Ciba Specialty Chemicals Corporation, High Point, N.C., where it is marketed as a stabilizer for dyed or printed polyester fiber materials. The stabilizer mixtures are very particularly suitable as light stabilizers (UV absorbers) in this regard.

Polyamide fiber material which is treated, before, during or after a dyeing or printing step with an effective stabilizing amount of a stabilizer mixture which comprises at least one compound of the formulae (1) and (2) and especially of the above formulae (1a) and (2a), have excellent thermal, oxidative and photochemical stability. Indeed the inventive process can be used to produce polyamide fabrics that can meet the most stringent heat and lightfastness requirements, both now and for the seeable future.

Preferably the polyamide fiber material is treated during a dyeing or printing step with an effective stabilizing amount of a stabilizer mixture which comprises at least one compound of the formulae (1) and (2) and especially of the above formulae (1a) and (2a).

Advantageously the dyeing or printing step is carried out in the presence of further stabilizers or antioxidants in addition to the stabilizer mixture which comprises at least one compound of the above formulae (1) and (2), preferably of the above formulae (1a) and (2a). Those further stabilizers advantageously include water soluble triazine derivatives known to stabilize polyamides such as those disclosed in DE 44 29 470 and U.S. Pat. Nos. 4,831,068, 5,160,346, 5,181,935, 5,197,991, 5,281,707, 5,457,198, 5,578,677, 5,696,262 and 5,700,295, the disclosures of which are incorporated by reference as well as 2-(2-hydroxyphenyl)-1,3,5-triazines, 2-(2'-hydroxyphenyl)benzotriazoles and organic copper complexed polyamide photostabilizers and mixtures thereof.

Examples of 2-(2-hydroxyphenyl)-1,3,5-triazines include 2,4,6-tris(2-hydroxy-4-octyloxyphenyl)-1,3,5-triazine, 2-(2-hydroxy-4-octyloxyphenyl)-4,6-bis(2,4-dimethylphenyl)-1,3,5-triazine, 2-(2,4-dihydroxyphenyl)-4,6-bis(2,4-dimethylphenyl)-1,3,5-triazine, 2,4-bis(2-hydroxy-4-propyloxyphenyl)-6-(2,4-dimethylphenyl)-1,3,5-triazine, 2-(2-hydroxy-4-octyloxyphenyl)-4,6-bis(4-methylphenyl)-1,3,5-triazine, 2-(2-hydroxy-4-dodecyloxyphenyl)-4,6-bis(2,4-dimethylphenyl)-1,3,5-triazine, 2-(2-hydroxy-4-tridecyloxyphenyl)-4,6-bis(2,4-dimethylphenyl)-1,3,5-triazine, 2-[2-hydroxy-4-(2-hydroxy-3-butyloxy-propoxy)phenyl]-4,6-bis(2,4-dimethyl)-1,3,5-triazine, 2-[2-hydroxy-4-(2-hydroxy-3-octyloxy-propyloxy)phenyl]-4,6-bis(2,4-dimethyl)-1,3,5-triazine, 2-[4-(dodecyloxy/tridecyloxy-2-hydroxypropoxy)-2-hydroxy-phenyl]-4,6-bis(2,4-dimethylphenyl)-1,3,5-triazine, 2-[2-hydroxy-4-(2-hydroxy-3-dodecyloxy-propoxy)phenyl]-4,6-bis(2,4-dimethylphenyl)-1,3,5-triazine, 2-(2-hydroxy-4-hexyloxy) phenyl-4,6-diphenyl-1,3,5-triazine, 2-(2-hydroxy-4-methoxyphenyl)-4,6-diphenyl-1,3,5-triazine, 2,4,6-tris[2-hydroxy-4-(3-butoxy-2-hydroxypropoxy)phenyl]-1,3,5-triazine, 2-(2-hydroxyphenyl)-4-(4-methoxyphenyl)-6-phenyl-1,3,5-triazine and 2-{2-hydroxy-4-[3-(2-ethylhexyl-1-oxy)-2-hydroxypropyloxy]phenyl}-4,6-bis(2,4-dimethylphenyl)-1,3,5-triazine.

Examples of 2-(2'-hydroxyphenyl)benzotriazoles include 2-(2'-hydroxy-5'-methylphenyl)-benzotriazole, 2-(3',5'-di-tert-butyl-2'-hydroxyphenyl)benzotriazole, 2-(5'-tert-butyl-2'-hydroxyphenyl)benzotriazole, 2-(2'-hydroxy-5'-(1,1,3,3-tetramethylbutyl)phenyl)benzotriazole, 2-(3',5'-di-tert-butyl-2'-hydroxyphenyl)-5-chloro-benzotriazole, 2-(3'-tert-butyl-2'-hydroxy-5'-methylphenyl)-5-chloro-benzotriazole, 2-(3'-sec-butyl-5'-tert-butyl-2'-hydroxyphenyl)benzotriazole, 2-(2'-hydroxy-4'-octyloxyphenyl)benzotriazole, 2-(3',5'-di-tert-amyl-2'-hydroxyphenyl)benzotriazole, 2-(3',5'-bis-(α,α-dimethylbenzyl)-2'-hydroxyphenyl)benzotriazole, 2-(3'-tert-butyl-2'-hydroxy-5'-(2-octyloxycarbonylethyl)phenyl)-5-chloro-benzotriazole, 2-(3'-tert-butyl-5'-[2-(2-ethylhexyloxy)-carbonylethyl]-2'-hydroxyphenyl)-5-chloro-benzotriazole, 2-(3'-tert-butyl-2'-hydroxy-5'-(2-methoxycarbonylethyl)phenyl)-5-chloro-benzotriazole, 2-(3'-tert-butyl-2'-hydroxy-5'-(2-methoxycarbonylethyl) phenyl)benzotriazole, 2-(3'-tert-butyl-2'-hydroxy-5'-(2-octyloxycarbonylethyl)phenyl)benzotriazole, 2-(3'-tert-butyl-5'-[2-(2-ethylhexyloxy)carbonylethyl]-2'-hydroxyphenyl) benzotriazole, 2-(3'-dodecyl-2'-hydroxy-5'-methylphenyl) benzotriazole, 2-(3'-tert-butyl-2'-hydroxy-5'-(2-isooctyloxycarbonylethyl)phenylbenzotriazole, 2,2'-methylene-bis[4-(1,1,3,3-tetramethylbutyl)-6-benzotriazole-2-ylphenol]; the transesterification product of 2-[3'-tert-butyl-5'-(2-methoxycarbonylethyl)-2'-hydroxyphenyl]-2H-benzotriazole with polyethylene glycol 300; $[R—CH_2CH_2—COO—CH_2CH_2]_2$— where R=3'-tert-butyl-4'-hydroxy-5'-2H-benzotriazol-2-ylphenyl, 2-[2'-hydroxy-3'-(α,α-dimethylbenzyl)-5'-(1,1,3,3-tetramethylbutyl)-phenyl]benzotriazole and 2-[2'-hydroxy-3'-(1,1,3,3-tetramethylbutyl)-5'-(α,α-dimethylbenzyl)-phenyl] benzotriazole.

Examples of organic copper complexed polyamide photostabilizers include those described U.S. Pat. Nos. 4,655,783, 4,704,133, 4,775,386 and 4,990,164, the disclosures of which are incorporated by reference, as well as nickel complexes of 2,2'-thio-bis-[4-(1,1,3,3-tetramethylbutyl)phenol], such as the 1:1 or 1:2 complex, with or without additional ligands such as n-butylamine, triethanolamine or N-cyclohexyldiethanolamine, nickel dibutyldithiocarbamate, nickel salts of the monoalkyl esters, e.g. the methyl or ethyl ester, of 4-hydroxy-3,5-di-tert-butylbenzylphosphonic acid, nickel complexes of ketoximes, e.g. of 2-hydroxy-4-methylphenyl undecylketoxime and nickel complexes of 1-phenyl-4-lauroyl-5-hydroxypyrazole, with or without additional ligands.

Examples of antioxidants include in particular the hindered phenolic antioxidant of the formula

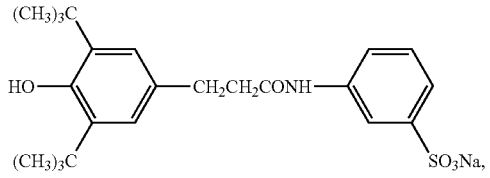

2-(2-hydroxyphenyl)-4-(4-methoxyphenyl)-6-phenyl-1,3,5-triazine of the formula

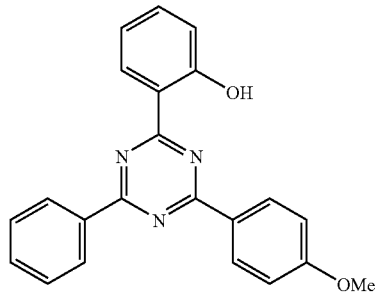

and the organic copper complexed polyamide photostabilizer of the formula

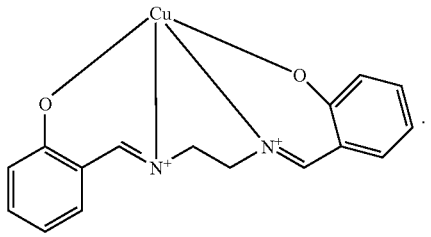

The amount of the stabilizer mixture which comprises at least one compound of the above formulae (1) and (2), preferably of the above formulae (1a) and (2a), can vary from about 0.02% to 3% by weight, preferably from about 0.05% to 1.5% by weight, especially 0.06% to 1% by weight, based on the total weight of the polyamide textile material.

The blends comprising further stabilizers in addition to the stabilizer mixture which comprises at least one compound of the above formulae (1) and (2), preferably of the above formulae (1a) and (2a), aid substantially in reducing the color fade and strength lost as opposed to the use of organic copper complexes, alone or in combination with benzotriazoles and even other triazines which have been traditionally used especially in nylon carpeting for automotive applications. When such blends are used the total stabilizer amount can vary from about 0.02% to 6% by weight, preferably from about 0.05% to 3% by weight, especially 0.06% to 1% by weight, based on the total weight of the polyamide fabric.

The term polyamide includes both polyamides and copolyamides derived from diamines and dicarboxylic acids and/or from aminocarboxylic acids or the corresponding lactams, such as polyamide 4, 6, 6/6, 6/10, 6/9, 6/12, 4/6, 12/12, 11 and 12, aromatic polyamides starting from m-xylene diamine and adipic acid; and polyamides prepared from hexamethylenediamine and isophthalic and/or terephthalic acid and with or without an elastomer as modifier, for example poly-2,4,4-trimethylhexamethylene terephthalamide or poly-m-phenylene isophthalamide.

The polyamide fiber materials of most interest consist predominately of nylon 6/6 or 6 fibers and mixtures thereof, particularly those that are to be used in fabrics such as carpeting for automotive vehicles.

These materials are usually dyed in an aqueous medium by the exhaust method or by a continuous method where the dye bath is applied to a continuously moving material with the appropriate application and subsequently fixed at elevated temperatures achieved with saturated steam, superheated steam, dry heat, or other means of providing energy required to achieve fixation. Said methods are all well known in the art. Exhaust methods would include but not restricted to typical methods used to dye polyamide such as stock dyeing, skein dyeing, package dyeing, becks, and jets. Continuous dyeing would include but not restricted to typical application methods used to dye polyamide such as, for yarn, warp dyeing, knits-de-knit, pad steam, and printing and for carpets, Kuster's Fluidyer, Fleissner, pad dye, foam dye, and jet printing.

The polyamide material employed can be in a variety of processing forms, e.g. in the form of fibers, yarns, carpets and rugs, non-wovens as well as in the form of woven fabrics or knitted fabrics. In one embodiment the polyamide material employed is in the form of an undyed carpet that is dyed batchwise or in a continuous manner.

Dyeing takes place from an aqueous liquor by a continuous or batch procedure. In the case of the batch procedure (exhaust procedure) the liquor to goods ratio can be chosen within a wide range, conveniently from 1:3 to 1:100 and preferably 1:10 to 1:40. The process is expediently carried out in the temperature range from 30 to 130° C., preferably from 50 to 95° C.

The amount of liquor applied in the continuous process is conveniently 40-700% by weight, preferably 40-500% by weight. The fiber material is then subjected to a heat treatment to fix the applied dyes. Fixation can also be carried out by the cold pad-batch method.

The heat treatment for fixing the dyes is preferably carried out in a steaming process by treatment in a steamer using steam or superheated steam in the temperature range from 90 to 125° C., typically for 1 to 10, preferably 1 to 5 minutes. Dye fixation by the cold pad-batch method can be carried out by storing the impregnated and preferably rolled-up material at room temperature (15 to 30° C.), conveniently for 3 to 24 hours, the batching time being dependent on the temperature and the dye, as those skilled in the art would know.

After completion of the dyeing process and fixation, the resultant dyeings are washed in a conventional manner and dried.

In the case of continuous dyeing procedures, the dyeing liquors, which in addition to the dyes may include further auxiliaries, are applied to the piece material by means, for example, of pad-mangling, spraying or knit padding, and are developed using thermofix or HT steam processes.

Where the stabilizer mixtures according to the invention are employed in the dyeing application, then application is such that, for example, the polyamide fibre material is first of all treated with these stabilizer mixtures and then dyeing is conducted, or, preferably, the fibre material is treated simultaneously with the stabilizer mixture and with the dye in the dyebath. However, the stabilizer mixtures can also be applied subsequently to the finished dyeing by means of thermofixing, for example at from 90 to 230° C. for a period of from 30 seconds to 5 minutes. It is also possible to pretreat the polyamide textile material with the stabilizer mixture.

The dyeing liquors may also include further additives, examples being dyeing assistants, dispersants, carriers, wetting agents and antifoams.

The dyebaths may additionally contain mineral acids, examples being sulfuric acid or phosphoric acid, or, more expediently, organic acids, for example aliphatic carboxylic acids such as formic acid, acetic acid, oxalic acid or citric acid, and/or salts, such as ammonium acetate, ammonium sulfate or sodium acetate. The purpose of the acids in particular is to control the pH of the liquors used in the dyeing process.

The dyeing is then rinsed again and dried. This produces on polyamide fiber material, in particular on synthetic polyamide fibers, deep and level dyeings, which, furthermore, are notable for good light fastness and rub fastness.

Dyeings to be photochemically and thermally stabilized in the practice of this invention are those which are produced by disperse, acid or metal complex dyes, preferably anthraquinones, and azo 1:2 metal complex dyes, for example 1:2 chromium complex, 1:2 cobalt complex dyes or copper complex dyes. Such dyes are well known to those in the art. Many are commercially available from Ciba Specialty Chemicals Corporation, High Point, N.C. under the IRGALAN® and LANACRON® designations.

For the preparation of prints, the stabilizer mixtures are added in the form of their aqueous dispersions to the printing pastes. The printing paste comprises the appropriate stabilizer mixture in amounts of, for example, from 0.01 to 15%, preferably from 0.1 to 5% active, based on the weight of the printing paste.

The amount of dyes added to the printing pastes depends on the desired shade; in general amounts of from 0.01 to 15 per cent by weight, preferably from 0.02 to 10 per cent by weight, based on the polyamide textile material employed, have been found to be appropriate.

In addition to the dyes and the aqueous stabilizer mixture dispersion, the printing pastes expediently comprise acid-stable thickeners, preferably of natural origin, such as cornflower derivatives, and especially sodium alginate on its own or as a mixture with modified cellulose, in particular with preferably from 20 to 25 per cent by weight of carboxymethylcellulose. In addition, the printing pastes may also include acid donors, such as butyrolactone or sodium hydrogen phosphate, preservatives, sequestering agents, emulsifiers, water-insoluble solvents, oxidizing agents or deaerating agents.

Particularly suitable preservatives include formaldehyde donors, such as paraformaldehyde or trioxane, especially aqueous formaldehyde solutions with concentrations of from about 30 to 40 per cent by weight. Examples of suitable sequestering agents include sodium nitrilotriacetate, sodium ethylenediaminetetraacetate and especially sodium polymetaphosphate, and most especially sodium hexametaphosphate. Particularly suitable emulsifiers are adducts of an alkylene oxide and a fatty alcohol, in particular an adduct of oleyl alcohol and ethylene oxide. Suitable water-insoluble solvents include high-boiling saturated hydrocarbons, especially paraffins with a boiling range of from about 160 to 210° C. (solvent naphthas). Examples of suitable oxidizing agents are aromatic nitro compounds, especially aromatic mono- or dinitrocarboxylic or -sulfonic acids, which may possibly be in the form of an alkylene oxide adduct, in particular a nitrobenzenesulfonic acid. Examples of suitable deaerating agents are high-boiling solvents, especially turpentine oils, higher alcohols, preferably $C_8$- to $C_{10}$alcohols, terpene alcohols or deaerating agents based on mineral oils and/or silicone oils, especially commercial formulations of from about 15 to 25 per cent by weight of a mineral and silicone oil mixture and from about 75 to 85 per cent by weight of a $C_8$alcohol such as 2-ethyl-n-hexanol.

In the course of printing the fiber materials, the printing paste is applied directly to the entire area or sections of the fiber material, advantageously using printing machines of customary construction, for example inkjet printing, vigoureux printing, intaglio printing, rotary screen printing or planographic printing machines.

After printing, the fiber material is dried at temperatures up to 150° C., preferably from 80° to 120° C.

The material is then stabilized by heat treatment at temperatures of preferably from 100° to 220° C. Heat treatment is generally effected under pressure using superheated steam.

Depending on temperature, this stabilization may take from 20 seconds to 10 minutes, preferably from 4 to 8 minutes.

The prints are finished in a customary manner by rinsing with water, and finishing can, if desired, be undertaken by additional reduction clearing in an alkaline medium, for example using sodium dithionite. In the latter case, the prints are again rinsed, dewatered and dried.

The present invention relates also to polyamide fiber material, especially synthetic polyamide textile material, for example a carpet, which has been dyed or printed by the process according to the invention.

As previously noted, polyamide fiber material which is treated, before, during or after a dyeing or printing step with an effective stabilizing amount of a stabilizer mixture which comprises at least one compound of the formulae (1) and (2) and especially of the above formulae (1a) and (2a), has excellent thermal, oxidative and photochemical stability. Indeed the inventive process can be used to produce dyed or printed polyamide fabrics, for example automotive carpet and upholstery fabrics, which can meet the most stringent heat and lightfastness requirements, both now and for the seeable future.

The following examples describe certain embodiments of this invention, but the invention is not limited thereto. It should be understood that numerous changes to the disclosed embodiments can be made in accordance with the disclosure herein without departing from the spirit or scope of the invention. These examples are therefore not meant to limit the scope of the invention. Rather, the scope of the invention is to be determined only by the appended claims and their equivalents. In these examples all parts and percentages are given by weight unless otherwise indicated. The amounts of the dyes and UV absorbers are based on pure substance.

In the following examples the general dyeing and evaluation procedures described below were followed.

A. General Laboratory Procedure for Exhaust Dyeing Polyamide Textile Material

Prepare, rinse and neutralize material as needed for the dyeing process:

1. Prepare dyebath (at room temperature) using deionized water to include the following:

| | |
|---|---|
| 1.0% | Irgasol ® SW* |
| 1.00% | Albegal ® FFA* |
| 2.00% | ammonium acetate |
| 0.375% | citric acid to pH 5.5 |
| 1.00%-2.00% | Cibafast ® N2* (fiber protectant) |
| X % | UV absorber mixture as described in the invention (predispersed) |
| Y % | dye mixture according to the color formulation (predissolved) |
| Z ml | cold water to increase volume to the final liquor ratio. |

*= available from Ciba Specialty Chemicals Corporation.

1. Add the material to be dyed to the mixture and place in a laboratory dyeing machine.
2. The machine temperature should be at 100° F. (38° C.). Load the dyeing vessel with the substrate to be dyed. Run for 10 minutes at 100° F. (38° C.).
3. Heat to 210-220° F. (98-105° C.) at 0.5° F. to 2° F. (0.25 to 1.1° C.) per minute and hold 30-60 minutes depending on difficulty of shade and fabric.
4. Cool to 140° F. (60° C.) and drop bath/remove fabric.
5. Give 2-minute clean, hot tap water rinse B. General Laboratory Pad-print or Pad Steam Procedure for Dyeing Polyamide Textile Material Prepare, rinse and neutralize fabric as needed for dyeing process:

1. Prepare dyebath (at room temperature) using deionized water to include the following:

| | |
|---|---|
| 1.0 g/l | Irgasol ® SW* |
| 1.0 g/l | Albegal ® FFA* |
| 2.0 g/l | ammonium acetate |
| 0.375 g/l | citric acid to pH 5.5 |
| 0.50 g/l | Invatex ® EDTA 30A* |
| 1.00%-2.00% | Cibafast ® N2* (fiber protectant) |
| X % | UV absorber as described in the invention (predispersed) |
| Y g/l | dye mixture according to the color formulation (predissolved) |
| Z ml | cold water to increase volume to the final liquor volume. |

*= available from Ciba Specialty Chemicals Corporation.

2. Prepare material to be dyed and place in a laboratory dyeing machine.
3. Set pad pressure, speed, and steamer temperature (230° F. (110° C.) for 8 minutes.
4. Add pad liquor and pad sample.
5. Give 2-minute clean, hot tap water rinse.

C. General laboratory procedure for continuous dyeing automotive carpet and application of UV absorber as described in the invention by process A—co-application in the dyebath or by process B—pad steam application after dyeing. A combination of process A and process B can be used.

Equipment:

Laboratory Dye Padder available from Eduard Küsters Maschinenfabrik GmbH & Co. KG of Germany;

Laboratory Overflow Applicator available from Fleissner GmbH & Co. of Germany, and Vertical Steamer available from Werner Mathis AG of Switzerland.

Process A. Co-application in Dyebath

1. Pad on wet out:

| | |
|---|---|
| 1.0 g/l | DOSS** @ 100% wet pick up |

2. Prepare dye bath

| | | |
|---|---|---|
| 1.0 | g/l | Irgasol ® SW* |
| 1.0 | g/l | Albegal ® FFA* |
| 2.0 | g/l | Ammonium Acetate |
| 0.375 | g/l | Citric Acid to pH 5.5 |
| 0.50 | g/l | Invatex ® EDTA 30A* |
| 1.0 to 2.0 | g/l | Cibafast N2* (fiber protectant) |
| X | g/l | UV absorber as described in the invention |
| Y | g/l | dye mixture according to the color formulation |
| Z | ml | Water to increase volume to the final liquor volume. |

*= available from Ciba Specialty Chemicals Corporation.
**= dioctylsulfosuccinate, available from Chemax Inc. under the name of DOSS/70 and from Calgene Chemical Inc. under the name of DOSS - 70, among others.

3. Apply dyebath with Fleissner applicator at 550% wet pick up.
4. Steam @ 212° F. (100° C.) for 2 to 10 Minutes.
5. Wash, extract excess moisture and dry.

Process B. Continuous Dyeing of the Carpet and Pad Steam or Pad Dry Application of UV Absorber.

1. Pad on wet out:

| | |
|---|---|
| 1.0 g/l | DOSS @ 100% wet pick up |

2. Prepare dye bath

| | | |
|---|---|---|
| 1.0 | g/l | Irgasol ® SW* |
| 1.0 | g/l | Albegal ® FFA* |
| 2.0 | g/l | Ammonium Acetate |
| 0.375 | g/l | Citric Acid to pH 5.5 |
| 0.50 | g/l | Invatex ® EDTA 30A* |
| 1.0 to 2.0 | g/l | Cibafast ® N2* (fiber protectant) |
| Y | g/l | dye mixture according to the color formulation |
| Z | ml | Water to increase volume to the final liquor volume. |

*= available from Ciba Specialty Chemicals Corporation.

3. Apply dyebath with Fleissner applicator at 550% wet pick up.
4. Steam @ 212° F. (100° C.) for 2 to 10 Minutes.
5. Wash, extract excess moisture.
6. Pad X g/l of UV absorber to get desired add on.
7. Fix with either steam or dry heat as described earlier.

D. General Procedure for Evaluation of Lightfastness of Dyed Automotive Textile Substrates The lightfastness testing is conducted in an Atlas CI4000 Weatherometer. The Weatherometer configuration consists of a high intensity xenon bulb supplying sufficient light and heat energy to degrade the substrate and the dye chromophores present in the fiber. The light emission spectrum is controlled by a series of light filters such as borosilicate and soda lime filters as in the GMW3414 test method. These filters allow the xenon emission spectrum to be modified and simulate the weathering that occurs when sunlight passes through the glass of an automobile. For this reason automotive window glass is sometimes employed as a filter over the fabric samples as in the TSL2606G test.

Other critical weathering factors such as chamber temperature and humidity are controlled in the CI4000 in order to supply a repeatable test method. The weathering endpoint is controlled by the energy adsorption onto a black panel present in the apparatus and is usually measured in joules, kilojoules or megajoules.

The evaluation of the degradation of the color of the fabric is measured by several methods. Often a spectral comparison is made between the faded sample and the original non-faded control utilizing a spectrometer such as the Hunter Lab Ultrascan XE or the Xrite CA22. Colorimetric software such as Helios (supplied by Ciba Specialty Chemicals) is then employed to give a numerical value to the shade change, usually in terms of a chroma and hue change or cast change (CIE lab deviation). The cast change reported here in terms of delta a (da*) and delta b (db*) units is desired to be as close to zero as possible, with a rating greater than 1.00 or less than −1.00 usually being rejected.

The second important numerical evaluation is the color depth loss. The determination of acceptable color loss, reported in the tables below as percent relative strength, is measured by utilizing a typical rating scale such as the American Association of Chemist and Colorist's (AATCC) Grey Scale Shade Change rating, which runs from 1 to 5, with 5 being the best and 1 being the worst. A 3 rating or higher is usually considered acceptable if the cast is also considered acceptable. This rating can also be determined with the colorimetric software.

EXAMPLE 1

Evaluation of lightfastness on polyamide automotive carpet commercially available from Magee Rieter, style Trentwood 14 oz; exposed to GM9538P testing (Arizona fade).

Dyeings on polyamide carpet with the following dye formulations were evaluated.

| | Dyebath Chemicals |
|---|---|
| Dye Formulation A | |
| 0.0210% Irgalan ® Yellow GRL* | 2.0% ammonium acetate |
| 0.0265% Irgalan ® Yellow 3RL* | 1.0% Irgasol ® SW* |
| 0.0285% Irgalan ® Bordeaux EL* | 1.0% Albegal ® FFA* |
| 0.0500% Irgalan ® Blue 3GL* | 0.375% citric acid to pH 5.5 |
| 0.0100% Irgalan ® Black RBLN* | 2.0% Cibafast ® N2* (fiber protectant) |
| Dye Formulation B | |
| 0.0620% Irgalan ® Yellow 3RL* | 2.0% ammonium acetate |
| 0.0050% Irgalan ® Bordeaux EL* | 1.0% Irgasol ® SW* |
| 0.1100% Irgalan ® Blue EL* | 1.0% Albegal ® FFA* |
| | 0.375% citric acid to pH 5.5 |
| | 2.0% Cibafast ® N2* |

*= available from Ciba Specialty Chemicals Corporation.

The following results were obtained.

| Lightfastness stabilizers | Comments | DL | Da | Db | Dc | Dh | DE | Exposure GM9538P |
|---|---|---|---|---|---|---|---|---|
| Dye formulation A | | | | | | | | |
| Control | green | 1.00 | −0.48 | −0.02 | −0.15 | 0.46 | 1.11 | 10KL |
| | yellow | 2.67 | 0.51 | 0.97 | 1.1 | −0.1 | 2.89 | 15KL |
| A control w/2% Cibafast ® VP 4611 | light, red, yellow | 2.07 | 1.62 | −0.3 | 0.2 | −1.63 | 2.64 | 10KL |
| | light, red, yellow | 2.03 | 2.16 | 0.21 | 0.92 | −1.96 | 2.97 | 15KL |
| B control w/and 2% Mixture A** | green yellow | 1.45 | 0.7 | 0.17 | 0.31 | −0.65 | 1.62 | 10KL |
| | yellow | 1.68 | 1.04 | 0.93 | 1.14 | −0.81 | 2.18 | 15KL |
| C control w/2% Cibafast P | ok | 2.39 | 1.01 | −0.14 | 0.22 | −0.99 | 2.6 | 10KL |
| | ok | 1.07 | 1.25 | −0.15 | 0.34 | −1.21 | 1.65 | 15KL |
| Dye formulation B | | | | | | | | |
| Control | ok, green yellow | 3.11 | 1.82 | −0.36 | 0.66 | −1.73 | 3.62 | 10KL |
| | borderline green yellow | 1.95 | 2.19 | −0.07 | 1.13 | −1.88 | 2.93 | 15KL |
| A control w/2% Cibafast VP 4611 | ok green yellow | −0.44 | 0.65 | −0.24 | −0.01 | −0.7 | 0.82 | 10KL |
| | light yellow green | 0.97 | 0.96 | 0.54 | 0.82 | −0.73 | 1.47 | 15KL |
| B control w/2% Mixture A** | green yellow | 0.58 | 0.43 | 0.42 | 0.51 | −0.32 | 0.84 | 10KL |
| | green yellow | 0.44 | 0.65 | 1.17 | 1.29 | −0.35 | 1.41 | 15KL |
| C control w/2% Cibafast P | green yellow | −0.38 | 0.7 | −0.39 | 0.09 | −0.8 | 0.89 | 10KL |
| | green yellow | −0.45 | 1.04 | −0.02 | 0.4 | −0.96 | 1.13 | 15KL |

**Mixture A is a mixture of stabilizer compounds comprising from 50 to 80% by weight of compounds of the formulae (1a) and from 50 to 20% by weight of the compounds of the formula (2a) disclosed above.

EXAMPLE 2

Evaluation to improve lightfastness on polyamide automotive carpet exposed to GMW 3414 testing (accelerated Arizona fade). The carpet samples used were of the type Dupont 1350 denier type 6.6 nylon and Dupont 1400 denier type 6.6 nylon.

Procedure: A gray shade was matched on the two different carpet substrates and with three different dye formulas. The shades were continuously dyed in a laboratory dyeing apparatus and tested for lightfastness according to the GMW 3414 test method after 451 kilojoules of irradiation. Each formulation was run without a UV absorber as a control then with 1% and 2% of previously described Mixture A in the dyebath. The lightfastness results were evaluated visually using the AATCC Grey Scale for color difference.

Continuous Dyeing:

| | g/l |
|---|---|
| Fabric Prep | |
| DOSS** | 1.0 |
| Temperature | 120° F. |
| Wet pick up | 90% |
| Chemicals | |
| DOSS | 1.0 |
| Cibaflow ® CIR* | 0.2 |
| Irgasol ® SW* | 1.0 |
| Cibafast ® N-2* | 1.5 |

**= dioctylsulfosuccinate, available from Chemax Inc. under the name of DOSS/70.

| Dyes | Grey Shade # 1 g/l | Grey Shade #2 g/l | Grey Shade # 3 g/l |
|---|---|---|---|
| Irgalan ® Yellow GRL 200%* | 0.099 | 0.0385 | 0.101 |
| Irgalan ® Bordeaux EL 200%* | 0.067 | | |
| Irgalan ® Blue 3GL 200%* | 0.172 | 0.125 | 0.163 |
| Irgalan ® Black RBLN* | | 0.0188 | |
| Lanacron ® Brown S-GL* | 0.2 | 0.314 | 0.179 |
| Irgalan ® Red B* | | | 0.038 |

| | |
|---|---|
| Fixation Time | 3.0 Min. |
| Dye application, % Pick up | 600 |

Results:

AATCC Grey Scale Evaluation for Arizona Fade at 15,000 Langleys

| | Substrates | 1350 denier | 1400 denier |
|---|---|---|---|
| Grey #1 | Control | 3/4 | 3 |
| | +1.0% Mixture A | 4/5 | 4 |
| | +2.0% Mixture A | 3/4 | 4/5 |
| Grey #2 | Control | 3/4 | 4 |
| | +1.0% Mixture A | 4 | 4 |
| | +2.0% Mixture A | 3/4 | 3/4 |
| Grey #3 | Control | 3/4 | 3/4 |
| | +1.0% Mixture A | 4 | 4 |
| | +2.0% Mixture 1 | 3/4 | 4/5 |

Comments: the degree of improvement appears to depend on the dye combination and on the fiber type.

EXAMPLE 3

Evaluation of lightfastness improvement on automotive carpet exposed to FAKRA testing.

FAKRA lightfastness testing is a European automotive lightfastness test method specified in DIN 75202. DIN is the German industrial standards organization. FAKRA is Normenausschuss Kraftfahrzeuge (FAKRA), the Automotive Standards Committee of DIN.

According to DIN 75202, the amount of light exposure is measured in cycles of a specified exposure level. European OEM's specify the number of cycles in this lightfastness test method depending on the textile article. For example, 3 cycles is standard for carpet, 5 cycles for upholstery, but it may go as high as 7 cycles for parts located in critical areas of an automobile such as rear shelf or front dash components.

The following testing results are from a study in Europe.

Testing parameters:

Substrate: PA 6.6 tufted carpet of automotive quality made by DuPont

Processed by the exhaust method.

Dyes used were typical acid grey/black dyes for lightfast automotive applications.

Lightfastness test method is FAKRA 3 periods and 5 periods.

Dye formulations:

A=Irgalan® Grey GLN.

B=50% Irgalan® Grey GLN+50% Isolan® Grey SGL.

C=50% Irgalan® Grey GLN+50% Lanasyn® Black S-GL.

Grey dyeings were carried out by the exhaust method with Cibafast® N2 alone in combination with Mixture 1.

Lightfastness tests results:

Lightfastness evaluated by gray scale method ISO 105-A05

| | FAKRA, 3 Periods | FAKRA, 5 Periods |
|---|---|---|
| Dye formula A + 1.5% Cibafast ® N2 | 4R | 3R |
| Dye formula A + 1.0% N2 + 3% Mixture A | 5 | 4-5 |
| Dye formula B + 1.5% N2 | 4R | 3R |
| Dye formula B + 1.0% N2 + 3% Mixture A | 4-5R | 4-5R |
| Dye formula C + 1.5% N2 | 4-5R | 4R |
| Dye formula C + 1.0% N2 + 3% Mixture A | 5 | 5 |

Summary of Testing Results:

Significant improvement by adding Mixture A resulting in 0.5 point to a 1.5 point improvement in lightfastness.

Tonal fade is improved by fading less red.

Able to reduce the amount of Cibafast® N2 from 1.5% to 1.0% without sacrificing lightfastness.

What is claimed is:

1. A process for enhancing the thermal, oxidative and photochemical stability of dyed or printed fiber material, wherein the fiber material is in the form of yarns, carpets, non-woven or woven fabrics or knitted fabrics, which comprises treating the fiber material, before, during or after a dyeing or printing step in an aqueous medium, with a stabilizer mixture which comprises at least one compound of the formula (1)

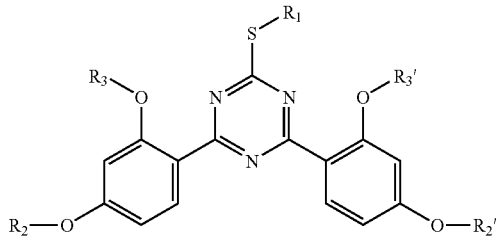

and at least one compound of the formula (2)

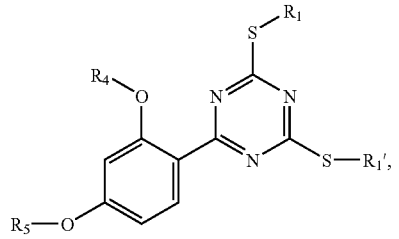

in which $R_1$ and $R_1'$ independently of one another are each linear or branched $C_1$-$C_{18}$ alkyl, $C_3$-$C_8$ cycloalkyl, $C_3$-$C_6$ alkenyl, unsubstituted or substituted aryl or $C_7$-$C_{12}$ aralkyl, $R_2$, $R_2'$, $R_3$, $R_3'$, $R_4$ and $R_5$ independently of one another are each hydrogen, unsubstituted or substituted, linear or branched $C_1$-$C_{12}$ alkyl, or linear or branched $C_4$-$C_{28}$ alkyl, which is interrupted by one or more N, S or O atoms and which may be substituted further or are a radical —CO—$R_6$ or —$SO_2$—$R_6$, and $R_6$ is $C_1$-$C_{12}$ alkyl, unsubstituted or $C_1$-$C_4$ alkyl-substituted phenyl or $C_7$-$C_{12}$ aralkyl and wherein the fiber material consists of polyamide fibers.

2. A method according to claim 1, in which $R_1$ and $R_1'$ are identical and are each $C_1$-$C_4$alkyl, cyclohexyl, allyl, phenyl or benzyl.

3. A method according to claim 1, which comprises treating the fiber material, before, during or after a dyeing or printing step in an aqueous medium, with a stabilizer mixture which comprises at least one compound of the formula (1a)

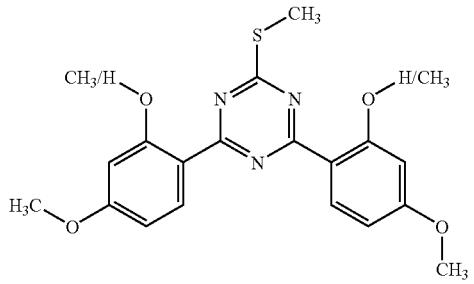

and at least one compound of the formula (2a)

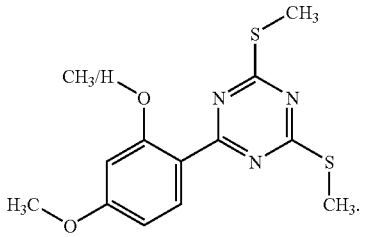

4. A method according to claim 1, in which the stabilizer mixture comprises from 50 to 80% by weight of compounds of the formulae (1) and from 50 to 20% by weight of the compounds of the formula (2), based on the total weight of compounds of the formulae (1) and (2).

5. A method according to claim 3, in which the stabilizer mixture comprises from 50 to 80% by weight of compounds of the formulae (1a) and from 50 to 20% by weight of compounds of the formula (2a), based on the total weight of compounds of the formulae (1a) and (2a).

6. A method according to claim 1, in which the fiber material is treated during a dyeing or printing step with the stabilizer mixture.

7. A method according to claim 3, in which the fiber material is treated during a dyeing or printing step with the stabilizer mixture.

8. A method according to claim 1, in which the dyeing or printing step is carried out in the presence of further stabilizers or antioxidants.

9. A method according to claim 8, in which the further stabilizers comprise water soluble triazine derivatives known to stabilize polyamides, 2-(2-hydroxyphenyl)-1,3,5-triazines, 2-(2'-hydroxyphenyl)benzotriazoles, organic copper complexed polyamide photostabilizers, and mixtures thereof.

10. A method according to claim 9, in which the further stabilizers comprise at least one of a compound of the formula

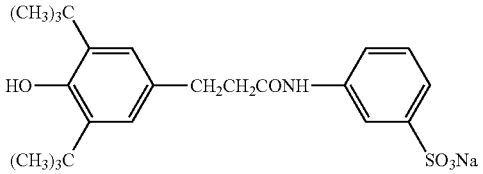

or of the formula

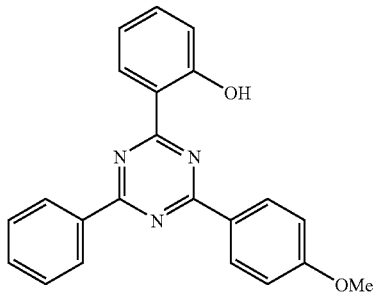

or of the formula

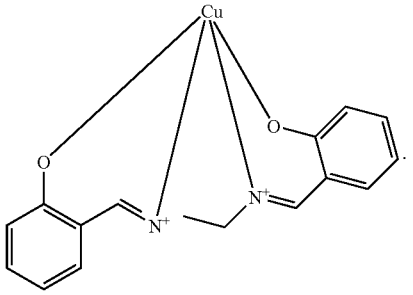

11. A method according to claim 1, in which the dyed or printed fiber material comprises a carpet.

* * * * *